US008655246B2

(12) United States Patent
Tokuda et al.

(10) Patent No.: US 8,655,246 B2
(45) Date of Patent: Feb. 18, 2014

(54) FIXING DEVICE AND IMAGE FORMING APPARATUS INCORPORATING SAME

(75) Inventors: Tetsuo Tokuda, Kanagawa (JP); Masaaki Yoshikawa, Tokyo (JP); Kenji Ishii, Kanagawa (JP); Hiroshi Yoshinaga, Chiba (JP); Naoki Iwaya, Tokyo (JP); Yoshiki Yamaguchi, Kanagawa (JP); Yutaka Ikebuchi, Kanagawa (JP); Ippei Fujimoto, Kanagawa (JP); Takuya Seshita, Kanagawa (JP); Takahiro Imada, Kanagawa (JP); Takamasa Hase, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 13/042,706

(22) Filed: Mar. 8, 2011

(65) Prior Publication Data

US 2011/0229226 A1 Sep. 22, 2011

(30) Foreign Application Priority Data

Mar. 18, 2010 (JP) ..... 2010-061850

(51) Int. Cl.
*G03G 15/20* (2006.01)

(52) U.S. Cl.
USPC ..... 399/329

(58) Field of Classification Search
USPC ..... 399/329, 320, 328
See application file for complete search history.

(56) References Cited

U.S. PATENT DOCUMENTS

| | | | | |
|---|---|---|---|---|
| 5,148,226 | A * | 9/1992 | Setoriyama et al. | 399/329 |
| 7,283,763 | B2 * | 10/2007 | Akizuki et al. | 399/69 |
| 7,536,145 | B2 * | 5/2009 | Tomine et al. | 399/328 |
| 8,364,052 | B2 | 1/2013 | Iwaya et al. | |
| 8,385,804 | B2 | 2/2013 | Hasegawa et al. | |
| 8,391,743 | B2 | 3/2013 | Masanao et al. | |
| 8,401,448 | B2 | 3/2013 | Hasegawa et al. | |
| 8,406,647 | B2 | 3/2013 | Shinshi et al. | |

(Continued)

FOREIGN PATENT DOCUMENTS

| | | |
|---|---|---|
| JP | 6-282183 | 10/1994 |
| JP | 6-337601 | 12/1994 |

(Continued)

OTHER PUBLICATIONS

Machine translation of reference Yuza et al. (Pub No. JP 06-282,183 A), Pub Date Oct. 7, 1994.*

(Continued)

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A fixing device includes a fixing member formed into a loop and rotatable in a predetermined direction of rotation. A heating assembly faces a first region on an inner circumferential surface of the fixing member to heat the fixing member. The heating assembly is thermally deformed to contact and move the fixing member. A first fixing member support and a second fixing member support face a second region on the inner circumferential surface of the fixing member other than the first region. The first fixing member support and the second fixing member support contact and support the rotating fixing member moved by the thermally deformed heating assembly.

17 Claims, 7 Drawing Sheets

(56) References Cited

U.S. PATENT DOCUMENTS

| | | | | |
|---|---|---|---|---|
| 8,422,901 | B2 | 4/2013 | Ishii et al. | |
| 8,428,502 | B2 | 4/2013 | Tokuda et al. | |
| 8,437,675 | B2 | 5/2013 | Ishii et al. | |
| 8,447,199 | B2 | 5/2013 | Ueno et al. | |
| 8,463,168 | B2 | 6/2013 | Shinshi et al. | |
| 2008/0095557 | A1* | 4/2008 | Horie | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052282 | A1 | 3/2011 | Shinshi et al. | |
| 2011/0058866 | A1 | 3/2011 | Ishii et al. | |
| 2011/0064437 | A1 | 3/2011 | Yamashina et al. | |
| 2011/0064490 | A1 | 3/2011 | Imada et al. | |
| 2011/0064502 | A1 | 3/2011 | Ehara et al. | |
| 2011/0085832 | A1 | 4/2011 | Hasegawa et al. | |
| 2011/0116848 | A1 | 5/2011 | Yoshikawa et al. | |

FOREIGN PATENT DOCUMENTS

| | | |
|---|---|---|
| JP | 08-248791 | 9/1996 |
| JP | 10-213984 | 8/1998 |
| JP | 4044075 | 2/1999 |
| JP | 8262903 | 4/2002 |
| JP | 1002982 | 9/2004 |
| JP | 2007-334205 | 12/2007 |
| JP | 2008-203455 | 9/2008 |
| JP | 2009-104019 | 5/2009 |
| JP | 2009-186784 | 8/2009 |

OTHER PUBLICATIONS

Machine translation of reference Yuza et al. (Pub No. JP 06-337,601 A), Pub Date Dec. 6, 1994.*

Office Action issued on Mar. 7, 2013, in Chinese Patent Application No. 201110058864.5.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-061850, filed on Mar. 18, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a fixing belt or a fixing film to apply heat to the recording medium bearing the toner image. FIG. 1 is a sectional view of a typical fixing device 20R1 including such fixing belt 204. The fixing belt 204 is looped around a heating roller 202 and a fixing roller 203, and a tension roller 206 biases the fixing belt 204. A pressing roller 205 presses against the fixing roller 203 via the fixing belt 204 to form a nip N between the pressing roller 205 and the fixing belt 204. The fixing belt 204 is heated by a heater 201 provided inside the heating roller 202. As a recording medium P bearing a toner image passes between the fixing roller 203 and the pressing roller 205 on the fixing belt 204, the fixing belt 204 and the pressing roller 205 apply heat and pressure to the recording medium P bearing the toner image to fix the toner image on the recording medium P.

One problem with such an arrangement, however, is that the heating roller 202 has a relatively large heat capacity, resulting in a longer warm-up time for the fixing device 20R1. To address this problem, instead of the fixing belt 204 the fixing device may employ a fixing film having a relatively small heat capacity. FIG. 2 is a sectional view of a fixing device 20R2 including such fixing film 213. A ceramic heater 211 is provided inside a loop formed by the fixing film 213. A pressing roller 212 presses against the ceramic heater 211 via the fixing film 213 to form a nip N between the pressing roller 212 and the fixing film 213. As a recording medium bearing a toner image passes between the pressing roller 212 and the fixing film 213, the fixing film 213 heated by the ceramic heater 211 and the pressing roller 212 apply heat and pressure to the recording medium bearing the toner image to fix the toner image on the recording medium.

However, the fixing film 213 also has a drawback in that, over time, friction between the ceramic heater 211 and the fixing film 213 sliding over the ceramic heater 211 increases, resulting eventually in unstable movement of the fixing film 213 and increasing the required driving torque of the fixing device 20R2. Moreover, the fixing film 213 has another drawback in that the ceramic heater 211 heats the fixing film 213 at the nip N only and therefore the rotating fixing film 213 is coolest when it reenters the nip N, resulting in formation of a faulty toner image on the recording medium due to the low temperature of the fixing film 213.

To overcome these drawbacks, instead of the ceramic heater 211 the fixing device may employ a heat generator provided inside the loop formed by the fixing film to heat a part of the fixing film. The heat generator is supported by a heat generator support provided inside the loop formed by the fixing film and generates heat to be transmitted to the fixing film. As the fixing film rotates while supported by a fixing film support provided inside the loop formed by the fixing film, the fixing film is heated by the heat generator.

A slight gap of predetermined size is provided between the fixing film and the heat generator and between the fixing film and the fixing film support. However, the heat generator support and the fixing film support may be deformed by the heat generated by the heat generator, varying the gap provided between the fixing film and the heat generator and between the fixing film and fixing film support. Accordingly, heat generated by the heat generator may not be transmitted to the fixing film uniformly in the axial direction of the fixing film due to the varied gap. Consequently, a part of the heat generator may be overheated due to insufficient heat transmission therefrom to the fixing film, resulting in malfunction of the fixing device.

BRIEF SUMMARY OF THE INVENTION

This specification describes below an improved fixing device. In one exemplary embodiment of the present invention, the fixing device fixes a toner image on a recording medium and includes an endless belt-shaped fixing member, a nip formation member, a pressing member, a heating assembly, a first fixing member support, and a second fixing member support. The fixing member is formed into a loop and rotatable in a predetermined direction of rotation. The nip formation member is provided inside the loop formed by the fixing member. The pressing member is provided outside the loop formed by the fixing member to press the fixing member against the nip formation member to form a nip between the pressing member and the fixing member through which the recording medium bearing the toner image passes. The heating assembly is disposed facing a first region on an inner circumferential surface of the fixing member to heat the fixing member. The heating assembly is thermally deformable to contact and move the fixing member. The first fixing member support is disposed facing a second region on the inner circumferential surface of the fixing member other than the first region and extends inward a predetermined distance from one lateral edge of the fixing member toward a center of the fixing member in an axial direction of the fixing member. The second fixing member support is disposed facing the second region and extends inward a predetermined distance from another lateral edge of the fixing member toward the center of the fixing member in the axial direction of the fixing member. At least after the fixing device is warmed up, the first fixing member support and the second fixing member support contact and support the rotating fixing member moved by the thermally deformed heating assembly.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
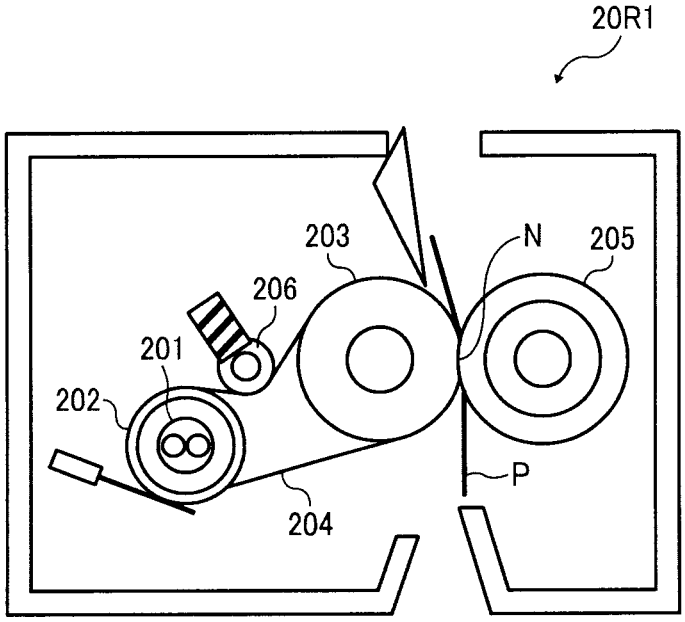
FIG. 1 RELATED ART
FIG. 1 is a schematic view of one related-art fixing device.
Figure 2:
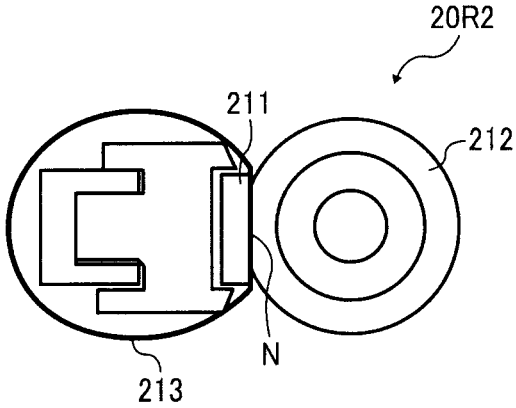
FIG. 2 RELATED ART
FIG. 2 is a schematic view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
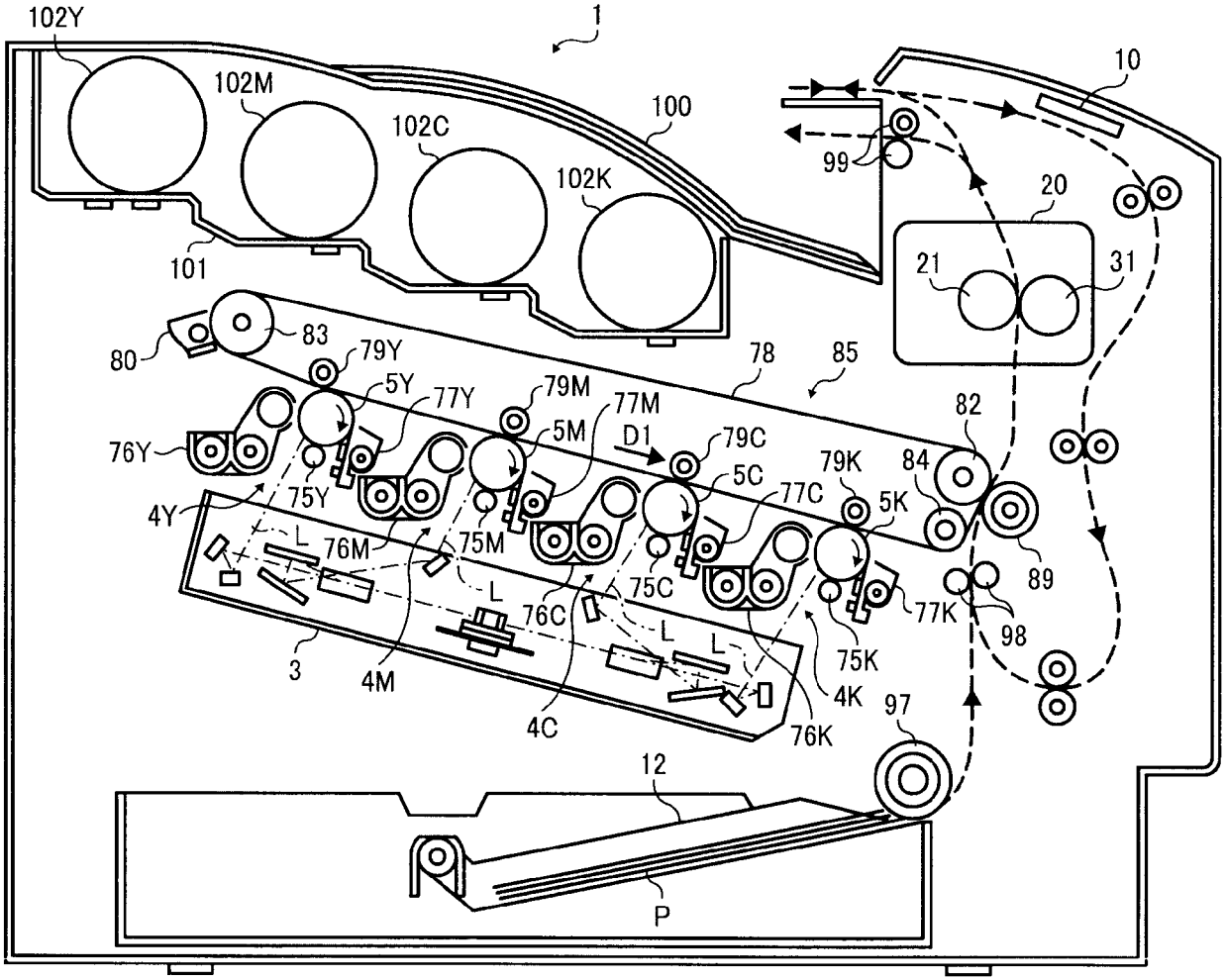
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic view of the image forming apparatus 1. As illustrated in FIG. 3, the image forming apparatus 1 may be a copier, a facsimile machine, a printer, a multifunction printer having at least one of copying, printing, scanning, plotter, and facsimile function, or the like. According to this exemplary embodiment of the resent invention, the image forming apparatus 1 is a tandem color printer for forming a color image on a recording medium.

As illustrated in FIG. 3, the image forming apparatus 1 includes image forming devices 4Y, 4M, 4C, and 4K disposed in a center portion of the image forming apparatus 1, a toner bottle holder 101 disposed above the image forming devices 4Y, 4M, 4C, and 4K in an upper portion of the image forming apparatus 1, an exposure device 3 disposed below the image forming devices 4Y, 4M, 4C, and 4K, a paper tray 12 disposed below the exposure device 3 in a lower portion of the image forming apparatus 1, an intermediate transfer unit 85 disposed above the image forming devices 4Y, 4M, 4C, and 4K, a second transfer roller 89 disposed opposite the intermediate transfer unit 85, a feed roller 97 and a registration roller pair 98 disposed between the paper tray 12 and the second transfer roller 89 in a recording medium conveyance direction, a fixing device 20 disposed above the second transfer roller 89, an output roller pair 99 disposed above the fixing device 20, a stack portion 100 provided downstream from the output roller pair 99 in the recording medium conveyance direction on top of the image forming apparatus 1, and a controller 10 (e.g., a central processing unit (CPU) provided with a random-access memory (RAM) and a read-only memory (ROM)) disposed in the upper portion of the image forming apparatus 1.

The toner bottle holder 101 includes toner bottles 102Y, 102M, 102C, and 102K. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is disposed below the toner bottle holder 101, and includes an intermediate transfer belt 78 formed into a loop, four first transfer bias rollers 79Y, 79M, 79C, and 79K, a second transfer backup roller 82, a cleaning backup roller 83, and a tension roller 84 disposed inside the loop formed by the intermediate transfer belt 78, and an intermediate transfer cleaner 80 disposed outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The image forming devices 4Y, 4M, 4C, and 4K are arranged opposite the intermediate transfer belt 78, and form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively, as a driving motor drives and rotates the photoconductive drums 5Y, 5M, 5C, and 5K clockwise in FIG. 3.

Specifically, in the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the respective photoconductive drums 5Y, 5M, 5C, and 5K according to image data sent from a client computer, for example. That is, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78. The four first transfer bias rollers 79Y, 79M, 79C, and 79K and the four photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P sent from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position at which the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., transfer sheets). Specifically, the feed roller 97 rotates counterclockwise in FIG. 3 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

After the secondary transfer process described above, the recording medium P bearing the color toner image is sent to the fixing device 20 that includes a fixing sleeve 21 and a pressing roller 31. The fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
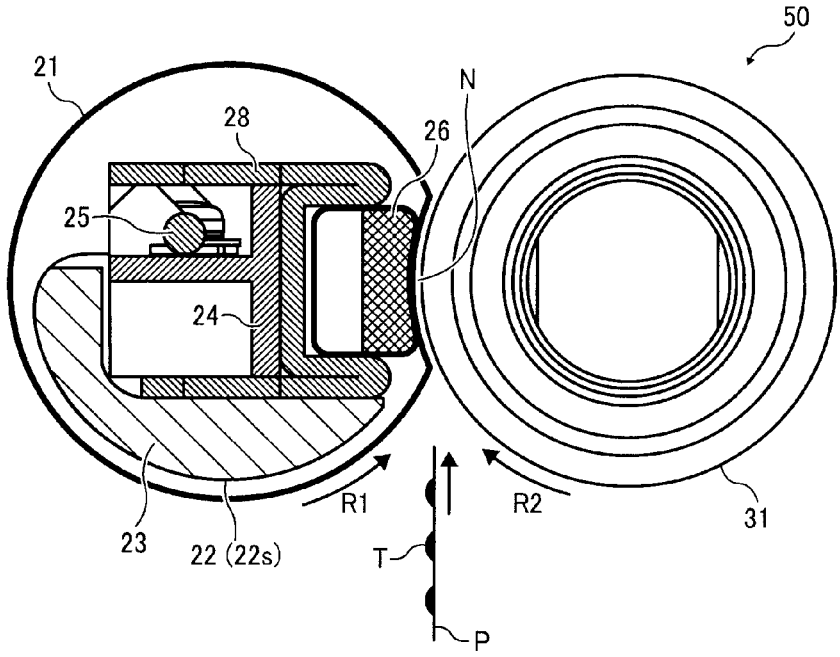
FIG. 4 is a vertical sectional view of a comparative fixing device.

Referring to FIG. 4, the following describes the structure of a comparative fixing device 50 that is comparative to the fixing device 20 depicted in FIG. 3.

FIG. 4 is a vertical sectional view of the comparative fixing device 50. As illustrated in FIG. 4, the comparative fixing device 50 includes the fixing sleeve 21 formed into a loop, a laminated heater 22, a heater support 23, a terminal stay 24, power supply wiring 25, a nip formation member 26, and a core holder 28, which are disposed inside the loop formed by the fixing sleeve 21, and the pressing roller 31 disposed outside the loop formed by the fixing sleeve 21.

As illustrated in FIG. 4, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The nip formation member 26 faces an inner circumferential surface of the fixing sleeve 21, and is pressed against the pressing roller 31 via the fixing sleeve 21 to form a nip N between the pressing roller 31 and the fixing sleeve 21 through which the recording medium P bearing a toner image T passes. The laminated heater 22 also faces the inner circumferential surface of the fixing sleeve 21, and is capable of contacting or being disposed close to the inner circumferential surface of the fixing sleeve 21 to heat the fixing sleeve 21 directly or indirectly. The heater support 23 faces the inner circumferential surface of the fixing sleeve 21 to support the laminated heater 22 at a predetermined position in such a manner that the laminated heater 22 is provided between the heater support 23 and the fixing sleeve 21. FIG. 4 illustrates the laminated heater 22 being isolated from the inner circumferential surface of the fixing sleeve 21 to distinguish the laminated heater 22 from the fixing sleeve 21. However, in actuality, the laminated heater 22 contacts the inner circumferential surface of the fixing sleeve 21 to heat the fixing sleeve 21 directly.

Figure 5A:
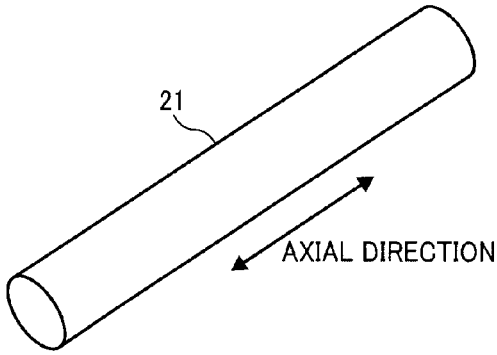
FIG. 5A is a perspective view of a fixing sleeve included in the comparative fixing device shown in FIG. 4.
Figure 5B:
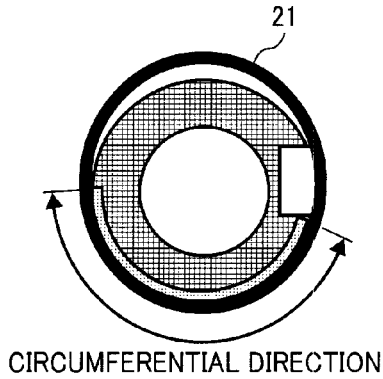
FIG. 5B is a vertical sectional view of the fixing sleeve shown in FIG. 5A.

Referring to FIGS. 5A and 5B, the following describes the fixing sleeve 21. FIG. 5A is a perspective view of the fixing sleeve 21. FIG. 5B is a vertical sectional view of the fixing sleeve 21. As illustrated in FIG. 5A, the fixing sleeve 21 is a flexible, pipe-shaped or cylindrical endless belt having a predetermined width in an axial direction of the fixing sleeve 21, which corresponds to a width of a recording medium P passing through the nip N formed between the fixing sleeve 21 and the pressing roller 31 depicted in FIG. 4. As illustrated in FIG. 5A, the axial direction of the pipe-shaped fixing sleeve 21 corresponds to a long axis, that is, a longitudinal direction, of the fixing sleeve 21. As illustrated in FIG. 5B, a circumferential direction of the pipe-shaped fixing sleeve 21 extends along a circumference of the fixing sleeve 21.

For example, the fixing sleeve 21 has an outer diameter of about 30 mm, and is constructed of a base layer made of a metal material and having a thickness in a range of from about 30 μm to about 50 μm, and at least a release layer disposed on the base layer. The base layer of the fixing sleeve 21 is made of a conductive metal material such as iron, cobalt, nickel, an alloy of those, or the like. The release layer of the fixing sleeve 21 is a tube having a thickness of about 50 μm and coated with a fluorine compound such as tetrafluoroethylene-perfluoroalkylvinylether copolymer (PFA). The release layer facilitates separation of toner of the toner image T on the recording medium P, which contacts the outer circumferential surface of the fixing sleeve 21 directly, from the fixing sleeve 21.

On the other hand, the pressing roller 31 depicted in FIG. 4 has an outer diameter of about 30 mm, and is constructed of a metal core made of a metal material such as aluminum or copper; a heat-resistant elastic layer provided on the metal core and made of silicon rubber (e.g., solid rubber); and a release layer provided on the elastic layer. The elastic layer has a thickness of about 2 mm. The release layer is a PFA tube covering the elastic layer and has a thickness of about 50 μm. Optionally, a heat generator, such as a halogen heater, may be disposed inside the metal core as needed.

The pressing roller 31 is connected to a pressure control mechanism that applies pressure to the pressing roller 31 to cause the pressing roller 31 to contact the outer circumferential surface of the fixing sleeve 21 and releases the pressure to separate the pressing roller 31 from the fixing sleeve 21. Specifically, the pressure control mechanism applies pressure to the pressing roller 31 to press the pressing roller 31 against the nip formation member 26 via the fixing sleeve 21 in a state in which the pressing roller 31 contacts the outer circumferential surface of the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P passing through the nip N moves along the concave portion of the fixing sleeve 21. By contrast, the pressure control mechanism releases the pressure applied to the pressing roller 31 to separate the pressing roller 31 from the outer circumferential surface of the fixing sleeve 21. Accordingly, the pressing roller 31 is not pressed against the nip formation member 26 via the fixing sleeve 21, and therefore the nip N is not formed between the pressing roller 31 and the fixing sleeve 21.

A driver drives and rotates the pressing roller 31, which presses the fixing sleeve 21 against the nip formation member 26, clockwise in FIG. 4 in a rotation direction R2. Accordingly, the fixing sleeve 21 rotates in accordance with rotation of the pressing roller 31 counterclockwise in FIG. 4 in a rotation direction R1 counter to the rotation direction R2 of the pressing roller 31.

A longitudinal direction of the nip formation member 26 is parallel to the axial direction of the fixing sleeve 21. At least a portion of the nip formation member 26 which is pressed against the pressing roller 31 via the fixing sleeve 21 is made of a heat-resistant elastic material such as fluorocarbon rubber. The core holder 28 holds and supports the nip formation member 26 at a predetermined position inside the loop formed by the fixing sleeve 21. Preferably, a portion of the nip formation member 26 which contacts the inner circumferential surface of the fixing sleeve 21 may be made of a slidable and durable material such as Teflon® sheet.

The core holder 28 is made of sheet metal, and has a predetermined width in a longitudinal direction thereof, corresponding to the width of the fixing sleeve 21 in the axial direction of the fixing sleeve 21. The core holder 28 is an H-shaped rigid member in cross-section disposed at substantially a center position inside the loop formed by the fixing sleeve 21.

The core holder 28 holds the respective components disposed inside the loop formed by the fixing sleeve 21 at predetermined positions. For example, the H-shaped core holder 28 includes a first concave portion facing the pressing roller 31, which houses and holds the nip formation member 26. That is, the core holder 28 is disposed opposite the pressing roller 31 via the nip formation member 26 to support the nip formation member 26 at a back face of the nip formation member 26 disposed back-to-back to a front face of the nip formation member 26 facing the nip N. Accordingly, even when the pressing roller 31 presses the fixing sleeve 21 against the nip formation member 26, the core holder 28 prevents substantial deformation of the nip formation member 26. In addition, the nip formation member 26 held by the core holder 28 protrudes from the core holder 28 slightly toward the pressing roller 31 to isolate the core holder 28 from the fixing sleeve 21 without contacting the fixing sleeve 21 at the nip N.

The H-shaped core holder 28 further includes a second concave portion disposed back-to-back to the first concave portion, which houses and holds the terminal stay 24 and the power supply wiring 25. The terminal stay 24 has a predetermined width in a longitudinal direction thereof, corresponding to the width of the fixing sleeve 21 in the axial direction of the fixing sleeve 21, and is T-shaped in cross-section. The power supply wiring 25 extends on the terminal stay 24, and transmits power supplied from an outside of the comparative fixing device 50. A part of an outer circumferential surface of the core holder 28 holds the heater support 23 that supports the laminated heater 22. In FIG. 4, the core holder 28 holds the heater support 23 in a lower half region inside the loop formed by the fixing sleeve 21, that is, in a semicircular region provided upstream from the nip N in the rotation direction R1 of the fixing sleeve 21. The heater support 23 is not adhered to the core holder 28 to suppress heat transmission from the heater support 23 to the core holder 28.

The heater support 23 supports the laminated heater 22 in such a manner that the laminated heater 22 contacts the inner circumferential surface of the fixing sleeve 21. Accordingly, the heater support 23 includes an arc-shaped outer circumferential surface having a predetermined circumferential length and disposed along the inner circumferential surface of the circular fixing sleeve 21 in cross-section.

Preferably, the heater support 23 has a heat resistance that resists heat generated by the laminated heater 22, a strength sufficient to support the laminated heater 22 without being deformed by the fixing sleeve 21 even when the rotating fixing sleeve 21 contacts the laminated heater 22, and a sufficient heat insulation so that heat generated by the laminated heater 22 is not transmitted to the core holder 28 but is transmitted to the fixing sleeve 21. For example, the heater support 23 is molded foam made of polyimide resin. Alternatively, a supplemental solid resin member may be provided inside the molded foam made of polyimide resin to improve rigidity.

Figure 6:
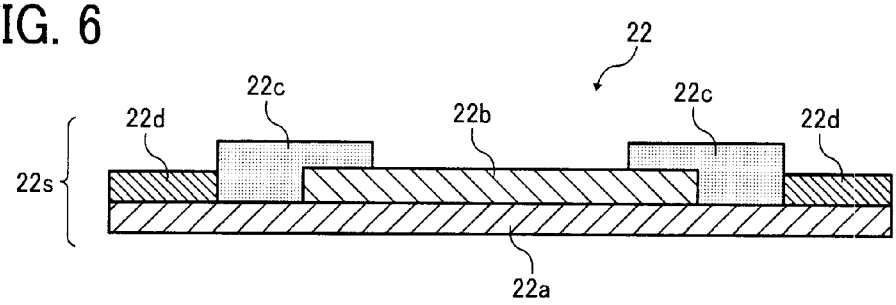
FIG. 6 is a horizontal sectional view of a laminated heater included in the comparative fixing device shown in FIG. 4.

Referring to FIG. 6, the following describes the laminated heater 22. FIG. 6 is a horizontal sectional view of the laminated heater 22. As illustrated in FIG. 6, the laminated heater 22 includes a heat generation sheet 22*s* constructed of a base layer 22*a* having insulation; a resistant heat generation layer 22*b* disposed on the base layer 22*a* and including conductive particles dispersed in a heat-resistant resin; an electrode layer 22*c* disposed on the base layer 22*a* to supply power to the resistant heat generation layer 22*b*; and an insulation layer 22*d* disposed on the base layer 22*a*. The heat generation sheet 22*s* is flexible, and has a predetermined width in the axial direction of the fixing sleeve 21 depicted in FIG. 5A and a predetermined length in the circumferential direction of the fixing sleeve 21 depicted in FIG. 5B. The insulation layer 22*d* insulates one resistant heat generation layer 22*b* from the adjacent electrode layer 22*c* of a different power supply system, and insulates an edge of the heat generation sheet 22*s* from an outside of the heat generation sheet 22*s*.

The laminated heater 22 further includes an electrode terminal provided at an edge of the heat generation sheet 22*s* at which the electrode terminal is connected to the electrode layer 22*c*. The electrode terminal receives power from the power supply wiring 25 depicted in FIG. 4 and supplies the power to the electrode layer 22*c*.

The heat generation sheet 22*s* has a thickness in a range of from about 0.1 mm to about 1.0 mm, and has a flexibility sufficient to wrap around the heater support 23 depicted in FIG. 4 at least along an outer circumferential surface of the heater support 23.

The base layer 22*a* is a thin, elastic film made of a resin having a certain level of heat resistance, such as polyethylene terephthalate (PET) or polyimide resin. For example, the base layer 22*a* is a film made of polyimide resin to provide heat resistance, insulation, and a certain level of flexibility.

The resistant heat generation layer 22*b* is a thin, conductive film in which conductive particles, such as carbon particles and metal particles, are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor made of a heat-resistant resin such as polyimide resin.

Alternatively, the resistant heat generation layer 22*b* may be manufactured by providing a thin conductive layer made of carbon particles and/or metal particles on the base layer 22*a* and then providing a thin insulation film made of a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles made of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* is manufactured by coating the base layer 22*a* with an insulation material including a heat-resistant resin identical to the heat-resistant resin of the base layer 22*a*, such as polyimide resin.

The electrode layer 22*c* is manufactured by coating the base layer 22*a* with a conductive ink or a conductive paste such as silver. Alternatively, metal foil or a metal mesh may be adhered to the base layer 22*a*.

The heat generation sheet 22*s* of the laminated heater 22 is a thin sheet having a small heat capacity, and is heated quickly. An amount of heat generated by the heat generation sheet 22*s* is arbitrarily set according to the volume resistivity of the resistant heat generation layer 22*b*. That is, the amount of heat generated by the heat generation sheet 22*s* can be adjusted according to the material, shape, size, and dispersion of conductive particles of the resistant heat generation layer 22*b*. For example, the laminated heater 22 providing heat generation per unit area of 35 W/cm$^2$ outputs a total power of about 1,200 W with the heat generation sheet 22*s* having a width of about 20 cm in the axial direction of the fixing sleeve 21 and a length of about 2 cm in the circumferential direction of the fixing sleeve 21, for example.

If a metal filament, such as a stainless steel filament, is used as a laminated heater, the metal filament causes asperities to appear on a surface of the laminated heater. Consequently, when the inner circumferential surface of the fixing sleeve 21 slides over the laminated heater, the asperities of the laminated heater abrade the surface of the laminated heater easily. To address this problem, the heat generation sheet 22*s* has a smooth surface without asperities as described above, improving durability in particular against wear due to sliding of the inner circumferential surface of the fixing sleeve 21 over the laminated heater 22. Further, a surface of the resistant heat generation layer 22*b* of the heat generation sheet 22*s* may be coated with fluorocarbon resin to further improve durability.

In FIG. 4, the heat generation sheet 22*s* of the laminated heater 22 faces the inner circumferential surface of the fixing sleeve 21 in a region in the circumferential direction of the fixing sleeve 21 between a position on the fixing sleeve 21 opposite the nip N via an axis of the fixing sleeve 21 and a position immediately upstream from the nip N in the rotation direction R1 of the fixing sleeve 21. Alternatively, the heat generation sheet 22*s* may face the fixing sleeve 21 in other region.

With the above-described configuration, the comparative fixing device 50 shortens a warm-up time and a first print time while at the same time saving energy. Further, since the heat generation sheet 22*s* of the laminated heater 22 is made of resin, even when rotation and vibration of the pressing roller 31 apply stress to the heat generation sheet 22*s* repeatedly, and therefore bend the heat generation sheet 22*s* repeatedly, the heat generation sheet 22*s* is not damaged due to fatigue failure and concomitant breakage, providing long-duration operation.

However, when the comparative fixing device 50 is powered on at a low ambient temperature, in the cold morning, for example, causing the laminated heater 22 supported by the heater support 23 to generate heat, a temperature differential may arise between the surfaces of the heater support 23, that is, between an outer surface of the heater support 23 which contacts the laminated heater 22 and an inner surface of the heater support 23, which is disposed back-to-back to the outer surface thereof and contacts the core holder 28, resulting in thermal expansion differential of the heater support 23.

Since the heater support 23 is not adhered to the core holder 28 as describe above, the heater support 23 is deformed due to the temperature differential between the outer surface and the inner surface thereof. For example, the outer surface of the heater support 23 is convex-shaped toward the laminated heater 22 in such a manner that a center portion of the heater support 23 protrudes outward with respect to lateral end portions thereof a longitudinal direction of the heater support 23 parallel to the axial direction of the fixing sleeve 21. Accordingly, the laminated heater 22 contacted by the deformed heater support 23 is also deformed. By contrast, the fixing sleeve 21 is not deformed in accordance with deformation of the laminated heater 22 due to its rigidity. Accordingly, the fixing sleeve 21 is locally isolated from the laminated heater 22 and therefore does not draw heat from the laminated heater 22, resulting in localized overheating of the laminated heater 22. That is, contact of the laminated heater 22 with the fixing sleeve 21 is destabilized in the axial direction of the fixing sleeve 21. For example, the laminated heater 22 may be locally isolated from the fixing sleeve 21 and therefore a portion of the laminated heater 22 that does not contact the fixing sleeve 21 is overheated due to insufficient heat transmission from the laminated heater 22 to the fixing sleeve 21. As a result, the fixing device 50 or the components disposed inside the fixing device 50 may be damaged.

Figure 7:
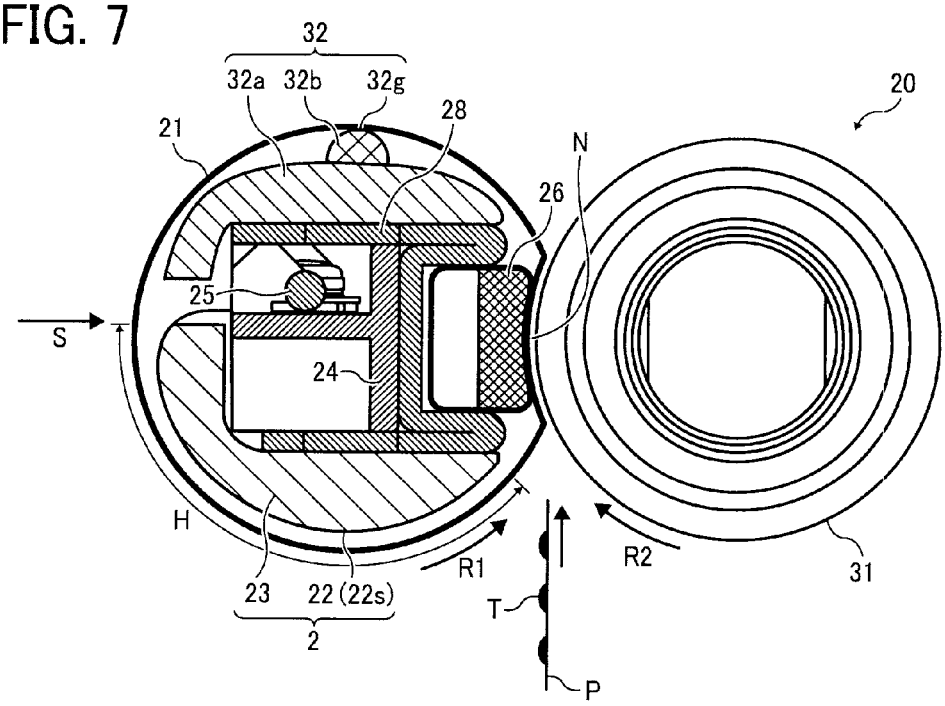
FIG. 7 is a vertical sectional view of a fixing device included in the image forming apparatus shown in FIG. 3.

Referring to FIG. 7, the following describes the structure of the fixing device 20 installed in the image forming apparatus 1 depicted in FIG. 3. FIG. 7 is a vertical sectional view of the fixing device 20 at an axial end thereof according to a first illustrative embodiment of the present invention.

As illustrated in FIG. 7, the fixing device 20 includes the fixing sleeve 21 formed into a loop, a heating assembly 2 including the laminated heater 22 and the heater support 23, the terminal stay 24, the power supply wiring 25, the nip formation member 26, the core holder 28, and fixing sleeve supports 32, which are disposed inside the loop formed by the fixing sleeve 21, and the pressing roller 31 disposed outside the loop formed by the fixing sleeve 21.

As illustrated in FIG. 7, the fixing sleeve 21 is a rotatable endless belt serving as a fixing member or a rotary fixing member. The pressing roller 31 serves as a pressing member or a rotary pressing member that contacts the outer circumferential surface of the fixing sleeve 21. The nip formation member 26 faces the inner circumferential surface of the fixing sleeve 21, and is pressed against the pressing roller 31 via the fixing sleeve 21 to form the nip N between the pressing roller 31 and the fixing sleeve 21 through which the recording medium P bearing the toner image T passes. The laminated heater 22 also faces the inner circumferential surface of the fixing sleeve 21, and is capable of contacting or being disposed close to the inner circumferential surface of the fixing sleeve 21 to heat the fixing sleeve 21 directly or indirectly. The heater support 23 faces the inner circumferential surface of the fixing sleeve 21 via the laminated heater 22 to support the laminated heater 22 at a predetermined position in such a manner that the laminated heater 22 is provided between the heater support 23 and the fixing sleeve 21. FIG. 7 illustrates the laminated heater 22 being isolated from the inner circumferential surface of the fixing sleeve 21 to distinguish the laminated heater 22 from the fixing sleeve 21. However, in actuality, the laminated heater 22 contacts the inner circumferential surface of the fixing sleeve 21 to heat the fixing sleeve 21 directly.

The heating assembly 2, which includes the laminated heater 22 and the heater support 23, heats a predetermined heating region H of the fixing sleeve 21 in the circumferential direction thereof.

The fixing sleeve supports 32 serve as a first fixing member support and a second fixing member support that support the fixing sleeve 21 serving as a fixing member. Specifically, each of the fixing sleeve supports 32 faces a region of the fixing sleeve 21 on the inner circumferential surface thereof other than the heating region H of the fixing sleeve 21 heated by the heating assembly 2 and has a predetermined width from a lateral edge toward a center of the fixing sleeve 21 in a longitudinal direction of the fixing sleeve support 32 parallel to the axial direction of the fixing sleeve 21. When the fixing device 20 is not yet warmed up, the fixing sleeve supports 32 do not contact the fixing sleeve 21. By contrast, when warm-up of the fixing device 20 is finished, the fixing sleeve supports 32 contact and support the fixing sleeve 21.

Figure 8:
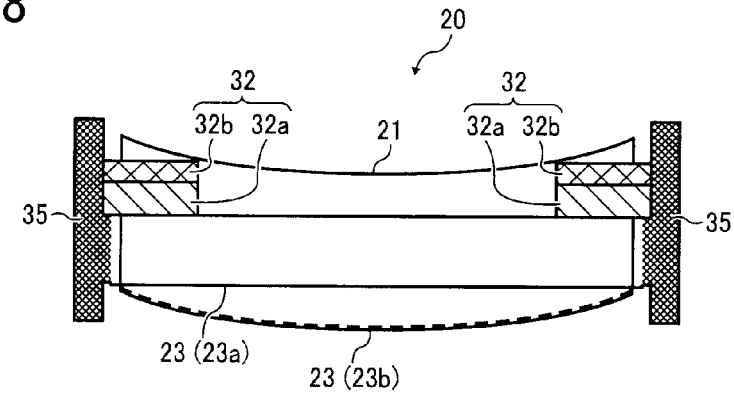
FIG. 8 is a horizontal sectional view of the fixing device shown in FIG. 7 illustrating thermal expansion of a heater support included in the fixing device.

Referring to FIG. 8, the following describes the configuration of the fixing sleeve supports 32 that contact the fixing sleeve 21 after the fixing device 20 is warmed up. FIG. 8 is a partial schematic view of the fixing device 20 seen in a direction S in FIG. 7.

The fixing sleeve supports 32 face the inner circumferential surface of the fixing sleeve 21 at lateral ends of the fixing sleeve 21 in the axial direction thereof, respectively. For example, the fixing sleeve supports 32 are mounted on flanges 35 that support the core holder 28 depicted in FIG. 7 at lateral ends of the core holder 28 in the longitudinal direction thereof in such a manner that the fixing sleeve supports 32 protrude from the flanges 35 toward the center of the fixing sleeve 21 in the axial direction thereof. According to this exemplary embodiment, each of the fixing sleeve supports 32 includes a support portion 32*a* disposed on the core holder 28 and a convex portion 32*b* disposed on the support portion 32*a*. The support portion 32*a* may have any shape that causes the convex portion 32*b* to contact and support the rotating fixing sleeve 21 at least when warm-up of the fixing device 20 is finished.

Preferably, the fixing sleeve support 32 is molded with the flange 35 to reduce the number of parts and manufacturing costs. Alternatively, the fixing sleeve support 32 may be a separate component that is attached to or mounted on the flange 35.

According to this exemplary embodiment, each of the fixing sleeve supports 32 has a width of about 20 mm in the axial direction of the fixing sleeve 21. If the fixing sleeve support 32 has a longer width that extends to the center of the fixing sleeve 21 in the axial direction thereof, frictional resistance increases between the fixing sleeve support 32 and the fixing sleeve 21 sliding over the fixing sleeve support 32, increasing torque of a driver that drives and rotates the pressing roller 31 that rotates the fixing sleeve 21. To address this problem, the fixing sleeve support 32 does not contact the fixing sleeve 21 when the fixing device 20 is not yet warmed up and contacts the fixing sleeve 21 after the fixing device 20 is warmed up. In addition, as described above, the fixing sleeve support 32 has a predetermined width extending from one lateral edge thereof contacting the flange 35 toward the center of the fixing sleeve 21 in the axial direction of the fixing sleeve 21. That is, the fixing sleeve support 32 extends inward a predetermined distance from one lateral edge toward the center of the fixing sleeve 21 in the axial direction thereof, which does not increase frictional resistance between the fixing sleeve support 32 and the fixing sleeve 21 sliding over the fixing sleeve support 32.

The fixing sleeve supports 32 face a non-heating region on the fixing sleeve 21 extending along the circumferential direction of the fixing sleeve 21 other than the heating region H on the fixing sleeve 21 faced by the laminated heater 22 depicted in FIG. 7 from which heat is transmitted to the fixing sleeve 21. Preferably, the non-heating region on the fixing sleeve 21 faced by the fixing sleeve supports 32 is disposed opposite the heating region H on the fixing sleeve 21 faced by the laminated heater 22 via the axis of the fixing sleeve 21.

Further, the fixing sleeve supports 32 are preferably disposed outside a conveyance region on the fixing sleeve 21 through which a maximum recording medium P that the fixing device 20 can accommodate passes in such a manner that the fixing sleeve supports 32 sandwich the conveyance region in the axial direction of the fixing sleeve 21 so that the fixing sleeve supports 32 do not adversely affect conveyance of the recording medium P.

Referring to FIG. 8, the following describes operation of the fixing sleeve supports 32. When the fixing device 20 is not yet warmed up, the fixing sleeve supports 32 do not contact the inner circumferential surface of the fixing sleeve 21 and a gap in a range of from about 0 mm to about 0.2 mm is provided between the fixing sleeve 21 and each of the fixing sleeve supports 32. Simultaneously, the heater support 23 is parallel to the long axis of the fixing sleeve 21 as illustrated in FIG. 8 with reference numeral 23*a*.

As the fixing device 20 is warmed up, the heater support 23 thermally expands by heat transmitted from the laminated heater 22 depicted in FIG. 7. After warm-up of the fixing device 20 is finished, the heater support 23 is deformed like a bow in which the center portion of the heater support 23 in the longitudinal direction thereof parallel to the axial direction of the fixing sleeve 21 protrudes toward the laminated heater 22 to have a convex portion as illustrated in FIG. 8 with reference numeral 23*b*. As driving of the fixing device 20 continues even after warm-up of the fixing device 20 is finished, the heater support 23 thermally expands further to widen the convex portion of the heater support 23 and flatten the overall heater support 23.

There is provided below a detailed description of a relation between the heater support 23 thermally expanded as described above, the fixing sleeve 21, and the fixing sleeve supports 32.

When the fixing device 20 is not yet warmed up, the fixing sleeve supports 32 are isolated from the inner circumferential surface of the fixing sleeve 21. As the fixing device 20 is warmed up, that is, as the laminated heater 22 generates heat, the heater support 23 contacting the laminated heater 22 is thermally expanded by the heat generated by the laminated heater 22. Specifically, the center portion of the heater support 23 in the longitudinal direction thereof is deformed into convex shape.

Accordingly, the convex center portion of the heater support 23 presses against a center portion of the fixing sleeve 21 in the axial direction thereof downward in FIG. 8. Since the fixing sleeve 21 has a certain rigidity, even when the convex center portion of the heater support 23 presses against the center portion of the fixing sleeve 21, the fixing sleeve 21 is not deformed and therefore maintains its straight shape in the axial direction thereof.

On the other hand, as the thermally expanded heater support 23 presses against and lowers the fixing sleeve 21, lateral end portions on the inner circumferential surface of the fixing sleeve 21 in the axial direction thereof, which face the fixing sleeve supports 32, come into contact with the respective fixing sleeve supports 32. As the heater support 23 is thermally expanded further, that is, as the convex center portion of the heater support 23 has a greater height, the fixing sleeve 21 no longer maintains its straight shape due to a reaction force received from the fixing sleeve supports 32. Accordingly, the center portion of the fixing sleeve 21 in the axial direction thereof, which is pressed by the heater support 23, is deformed into convex shape along the convex center portion of the heater support 23 to come into contact with a center portion of the laminated heater 22 in a longitudinal direction of the laminated heater 22 parallel to the axial direction of the fixing sleeve 21. Simultaneously, the lateral end portions of the fixing sleeve 21 in the axial direction thereof are also bent and come into contact with lateral end portions of the laminated heater 22 in the longitudinal direction thereof.

By contrast, with the configuration of the fixing device 50 depicted in FIG. 4 without the fixing sleeve supports 32, when the fixing device 20 is warmed up, the center portion of the laminated heater 22 in the longitudinal direction thereof is deformed along the convex center portion of the heater support 23. Accordingly, the center portion of the fixing sleeve 21 in the axial direction thereof is also deformed along the deformed center portion of the laminated heater 22. However, the lateral end portions of the fixing sleeve 21 in the axial direction thereof are not deformed along the deformed laminated heater 22 due to its rigidity. Accordingly, the lateral end portions of the fixing sleeve 21 are isolated from the heater support 23 and the laminated heater 22 with a substantial gap between the fixing sleeve 21 and the laminated heater 22, disturbing heat transmission from the laminated heater 22 to the fixing sleeve 21. As a result, the laminated heater 22 is overheated due to insufficient heat transmission from the laminated heater 22 to the fixing sleeve 21.

By contrast, when the fixing device 20 is driven even after warm-up of the fixing device 20 is finished, the overall heater support 23 thermally expanded is flattened, and therefore the fixing sleeve 21 contacts the laminated heater 22 flattened along the flattened heater support 23 over the entire width of the fixing sleeve 21 in the axial direction thereof. Accordingly, the laminated heater 22 is not overheated.

To address the above-described problem of overheating of the laminated heater 22 with the configuration lacking the fixing sleeve supports 32, according to this exemplary embodiment, the fixing sleeve supports 32 do not contact the fixing sleeve 21 when the fixing device 20 is not yet warmed up but contact and support the fixing sleeve 21 when warm-up of the fixing device 20 is finished. Further, each of the fixing sleeve supports 32 has a predetermined width extending from each lateral edge of the fixing sleeve 21 toward the center of the fixing sleeve 21 in the axial direction thereof to cause the fixing sleeve 21 to contact the laminated heater 22 precisely over the entire width of the fixing sleeve 21 in the axial direction thereof.

Accordingly, even when the heater support 23 is thermally expanded like a bow in such a manner that the center portion of the heater support 23 protrudes outward with respect to the lateral end portions thereof in the longitudinal direction of the heater support 23 parallel to the axial direction of the fixing sleeve 21 to have the convex shape, the laminated heater 22 and the fixing sleeve 21 are deformed along the convex-shaped heater support 23 over the entire width of the fixing sleeve 21 in the axial direction thereof. Consequently, the fixing sleeve 21 contacts the laminated heater 22 over the entire width of the fixing sleeve 21, preventing localized overheating of the laminated heater 22 due to insufficient heat transmission from the laminated heater 22 to the fixing sleeve 21 and concomitant breakage of the fixing device 20. Further, frictional resistance between the laminated heater 22 and the fixing sleeve 21 sliding over the laminated heater 22 does not increase, preventing increase of the torque of the driver of the fixing device 20.

Referring to FIGS. 9 to 11A, the following describes variations of the fixing sleeve support 32 serving as a fixing member support that supports the fixing sleeve 21. In FIGS. 9 to 11A, each of the fixing member supports is disposed facing the non-heating region on the inner circumferential surface of the fixing sleeve 21 other than the heating region H on the inner circumferential surface of the fixing sleeve 21 where the heating assembly 2 heats the fixing sleeve 21. Further, the fixing member support has a predetermined width extending from the lateral edge of the fixing sleeve 21 to a predetermined inner position on the fixing sleeve 21 in the axial direction thereof. The fixing member support contacts and supports the fixing sleeve 21 at least when warm-up of the fixing device 20 is finished to suppress change in surface pressure with which the laminated heater 22 contacts the fixing sleeve 21.

Figure 9:
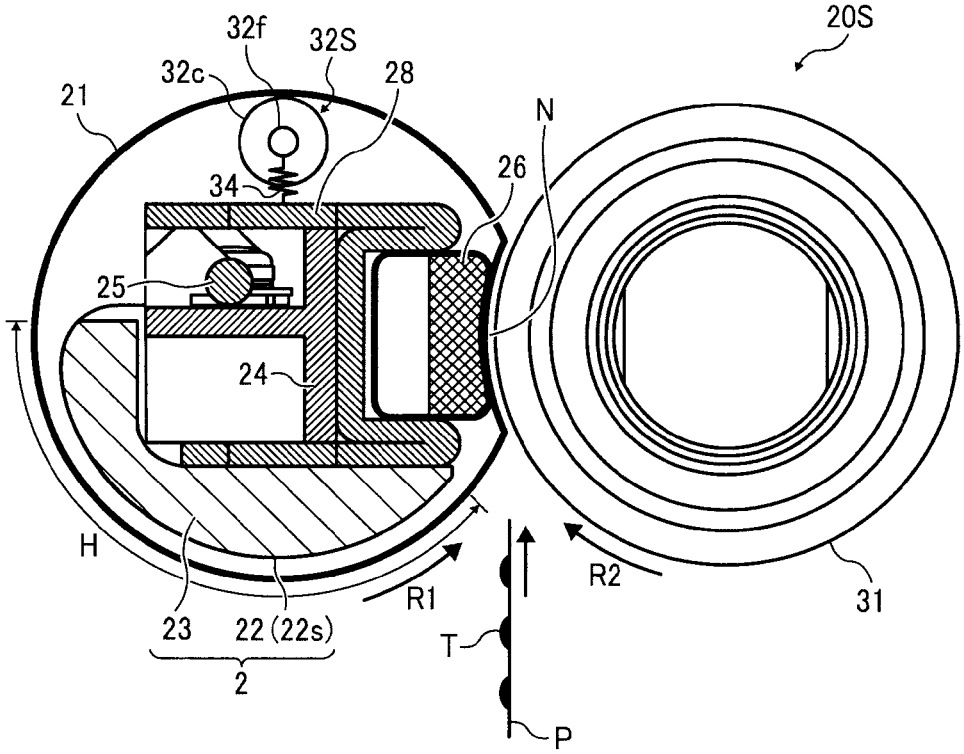
FIG. 9 is a vertical sectional view of a fixing device according to another exemplary embodiment of the present invention.

FIG. 9 is a vertical sectional view of a fixing device 20S according to a second illustrative embodiment of the present invention. As illustrated in FIG. 9, the fixing device 20S includes fixing sleeve supports 32S each of which includes a core 32*f*, an elastic member 32*c* covering the core 32*f*, and a spring 34 that supports the core 32*f*.

Each of the fixing sleeve supports 32S, serving as a fixing member support that supports the fixing sleeve 21 serving as a fixing member, includes the core 32*f* supported by the spring 34 mounted on the core holder 28. The spring 34 biases the core 32*f* against the fixing sleeve 21 so that the elastic member 32*c* covering the core 32*f* contacts and presses against the inner circumferential surface of the fixing sleeve 21.

When the fixing device 20S is not yet warmed up, the elastic members 32*c* disposed at both lateral ends of the fixing sleeve 21 in the axial direction thereof do not contact the inner circumferential surface of the fixing sleeve 21. Alternatively, the elastic members 32*c* may be configured to contact the inner circumferential surface of the fixing sleeve 21 when the fixing device 20S is not yet warmed up.

As the fixing device 20S is warmed up and therefore the heater support 23 thermally expands, the thermally expanded heater support 23 moves the fixing sleeve 21 downward in FIG. 9. Specifically, the thermally expanded heater support 23 is deformed like a bow in which the center portion of the heater support 23 protrudes outward with respect to the lateral end portions of the heater support 23 in the axial direction of the fixing sleeve 21 as illustrated in FIG. 8 when warm-up of the fixing device 20S is finished. The protruding center portion of the heater support 23 presses against and lowers the center portion of the fixing sleeve 21 in the axial direction thereof. Simultaneously, the fixing sleeve 21 comes into contact with the elastic members 32*c* as the heater support 23 lowers the fixing sleeve 21. By contrast, the lateral end portions of the fixing sleeve 21 in the axial direction thereof, which face the heater support 23, tend to separate from the lateral end portions of the laminated heater 22 in the axial direction of the fixing sleeve 21 due to rigidity of the fixing sleeve 21. However, the elastic members 32*c* contacting the lateral end portions of the fixing sleeve 21 prevent the lateral end portions of the fixing sleeve 21 facing the laminated heater 22 from separating from the lateral end portions of the laminated heater 22.

With this configuration, even when the thermally expanded heater support 23 is deformed like a bow in which the center portion of the heater support 23 protrudes outward with respect to the lateral end portions of the heater support 23 in the axial direction of the fixing sleeve 21 as illustrated in FIG. 8 when warm-up of the fixing device 20S is finished, the fixing sleeve supports 32S support the rotating fixing sleeve 21 while suppressing change in surface pressure with which the laminated heater 22 contacts the fixing sleeve 21, that is, while causing the fixing sleeve 21 to contact the laminated heater 22 over the entire width of the fixing sleeve 21 in the axial direction thereof, thus preventing localized overheating of the laminated heater 22 due to insufficient heat transmission from the laminated heater 22 to the fixing sleeve 21.

Figure 10:
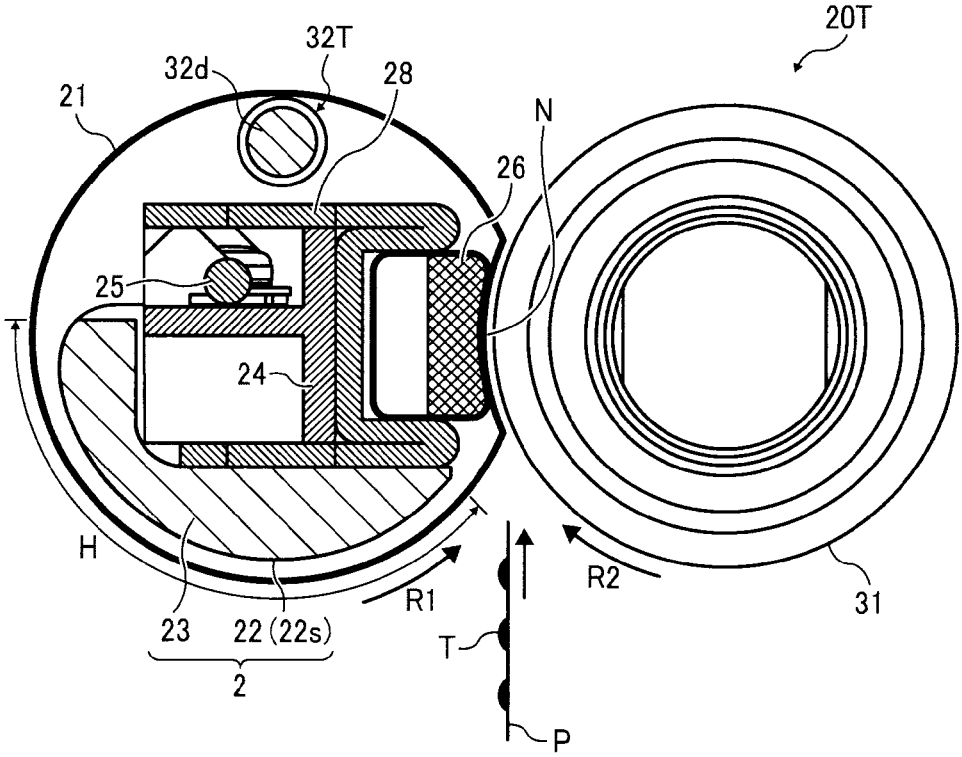
FIG. 10 is a vertical sectional view of a fixing device according to yet another exemplary embodiment of the present invention.

FIG. 10 is a vertical sectional view of a fixing device 20T according to a third illustrative embodiment of the present invention. As illustrated in FIG. 10, the fixing device 20T includes fixing sleeve supports 32T, each of which serves as a fixing member support that supports the fixing sleeve 21 serving as a fixing member, and includes an elastic rotor 32*d*.

The fixing sleeve supports 32T are rotatably supported by the flanges 35 depicted in FIG. 8 that support the core holder 28 at the lateral ends of the core holder 28 in the longitudinal direction thereof, respectively. The elastic rotor 32*d* is made of sponge or rubber and contacts the inner circumferential surface of the fixing sleeve 21 at each lateral end of the fixing sleeve 21 in the axial direction thereof.

When the fixing device 20T is not yet warmed up, the elastic rotors 32*d* disposed at both lateral ends of the fixing sleeve 21 in the axial direction thereof do not contact the inner circumferential surface of the fixing sleeve 21. Alternatively, the elastic rotors 32*d* may be configured to contact the inner circumferential surface of the fixing sleeve 21 when the fixing device 20T is not yet warmed up.

As the fixing device 20T is warmed up and therefore the heater support 23 thermally expands, the thermally expanded heater support 23 moves the fixing sleeve 21 downward in FIG. 10. Specifically, the thermally expanded heater support 23 is deformed like a bow in which the center portion of the heater support 23 protrudes outward with respect to the lateral end portions of the heater support 23 in the axial direction of the fixing sleeve 21 as illustrated in FIG. 8 when warm-up of the fixing device 20T is finished. The protruding center portion of the heater support 23 presses against and lowers the center portion of the fixing sleeve 21 in the axial direction thereof. Simultaneously, the fixing sleeve 21 comes into contact with the elastic rotors 32*d* as the heater support 23 lowers the fixing sleeve 21. By contrast, the lateral end portions of the fixing sleeve 21 in the axial direction thereof, which face the heater support 23, tend to separate from the lateral end portions of the laminated heater 22 in the axial direction of the fixing sleeve 21 due to rigidity of the fixing sleeve 21. However, the elastic rotors 32*d* contacting the lateral end portions of the fixing sleeve 21 prevent the lateral end portions of the fixing sleeve 21 facing the laminated heater 22 from separating from the lateral end portions of the laminated heater 22.

With this configuration, similarly to the fixing sleeve supports 32S depicted in FIG. 9, even when the thermally expanded heater support 23 is deformed like a bow in which the center portion of the heater support 23 protrudes outward with respect to the lateral end portions of the heater support 23 in the axial direction of the fixing sleeve 21 as illustrated in FIG. 8 when warm-up of the fixing device 20T is finished, the fixing sleeve supports 32T support the rotating fixing sleeve 21 while suppressing change in surface pressure with which the laminated heater 22 contacts the fixing sleeve 21, that is, while causing the fixing sleeve 21 to contact the laminated heater 22 over the entire width of the fixing sleeve 21 in the axial direction thereof, thus preventing overheating of the laminated heater 22 due to insufficient heat transmission from the laminated heater 22 to the fixing sleeve 21.

Further, the elastic rotors 32*d* decrease frictional resistance between the elastic rotors 32*d* and the inner circumferential surface of the fixing sleeve 21 sliding over the elastic rotors 32*d*. Accordingly, the elastic rotors 32*d* prevent the torque of the driver that drives and rotates the pressing roller 31 from increasing due to the frictional resistance between the elastic rotors 32*d* and the fixing sleeve 21.

Figure 11A:
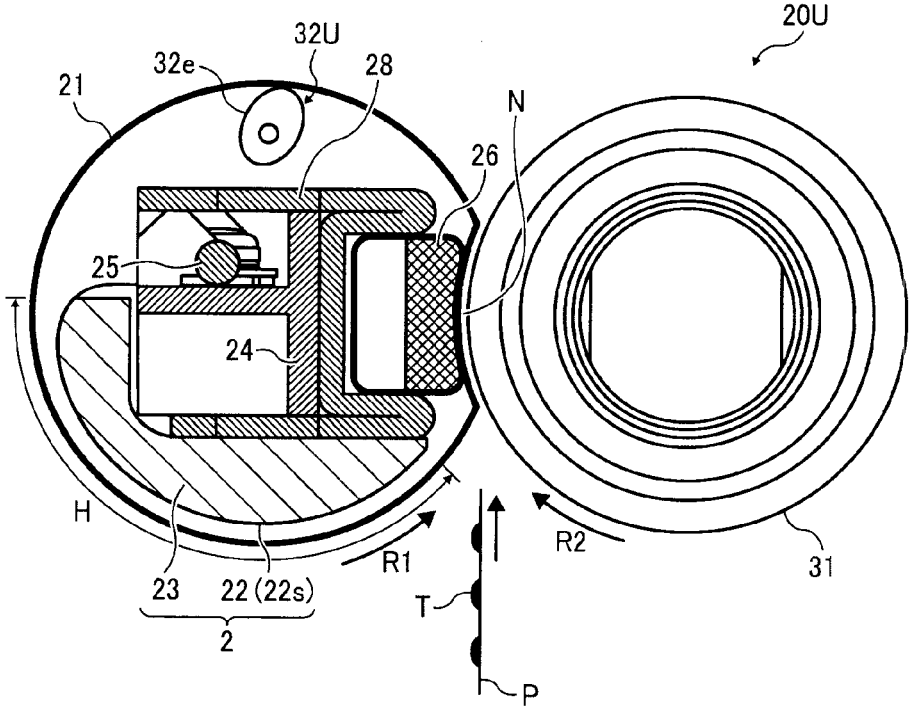
FIG. 11A is a vertical sectional view of a fixing device according to yet another exemplary embodiment of the present invention.

FIG. 11A is a vertical sectional view of a fixing device 20U according to a fourth illustrative embodiment of the present invention. As illustrated in FIG. 11A, the fixing device 20U includes fixing sleeve supports 32U, each of which serves as a fixing member support that supports the fixing sleeve 21 serving as a fixing member, and includes a disk cam 32*e* that rotates and contacts the inner circumferential surface of the fixing sleeve 21 at an arbitrary part of an outer circumferential surface of the disk cam 32*e*, that is, along an outer circumferential edge of the disk cam 32*e*.

The fixing sleeve supports 32U are rotatably supported by the flanges 35 depicted in FIG. 8 that support the core holder 28 at the lateral ends of the core holder 28 in the longitudinal direction thereof, respectively. The rotatable disk cam 32*e* contacts the inner circumferential surface of the fixing sleeve 21 at an arbitrary height at each lateral end of the fixing sleeve 21 in the axial direction thereof.

Figure 11B:
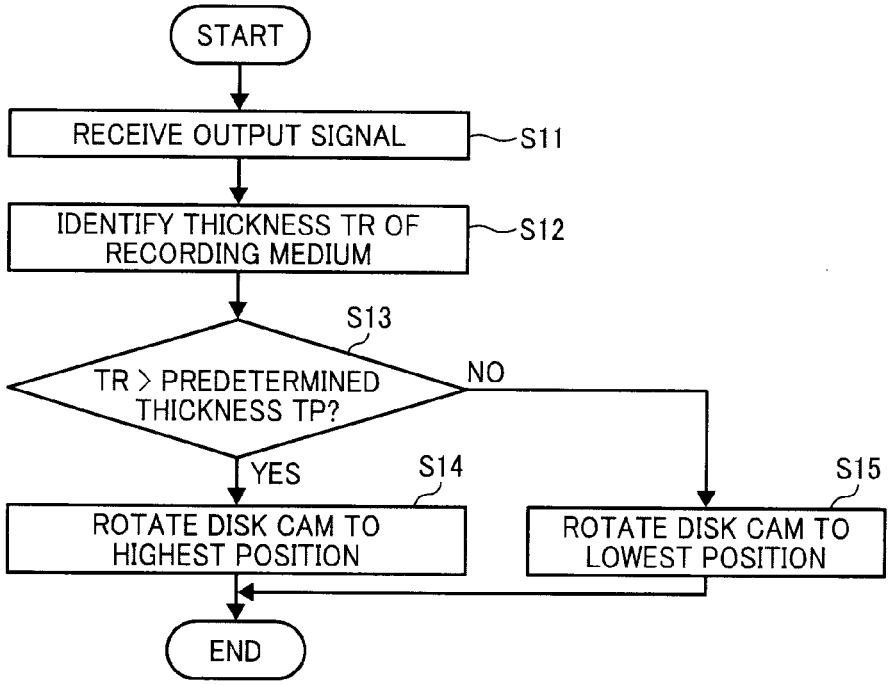
FIG. 11B is a flowchart illustrating processes for controlling a disk cam included in the fixing device shown in FIG. 11A.

It is to be noted that the desired fixing temperature varies depending on the type of the recording medium P, and in particular the thickness of the recording medium P. For example, a desired fixing temperature for thick sheets is different from and generally higher than a desired fixing temperature for thin sheets. Accordingly, an amount of thermal deformation of the heater support 23, that is, an amount of convex deformation of the center portion of the heater support 23 in the axial direction of the fixing sleeve 21 varies depending on the preset fixing temperature selected according to the type of the recording medium P. To address this circumstance, the controller 10 depicted in FIG. 3 performs control processes described below for controlling the disk cam 32*e*. FIG. 11B is a flowchart illustrating such processes performed by the controller 10.

In step S11, the image forming apparatus 1 depicted in FIG. 3 receives an output signal indicating the type of the recording medium P, that is, a thick sheet or a thin sheet. The type of the recording medium P is specified by a user with a control panel disposed atop the image forming apparatus 1 or with a client computer, or detected automatically by a sheet type detector disposed inside the image forming apparatus 1.

In step S12, the controller 10 identifies a thickness TR of the recording medium P from the received output signal or from readings supplied by the sheet type detector.

In step S13, the controller 10 determines whether or not the identified thickness TR of the recording medium P is greater than a predetermined thickness TP.

When the controller 10 determines in step S13 that the recording medium P is a thick sheet having the thickness TR greater than the predetermined thickness TP, in step S14 the controller 10 rotates the disk cam 32*e* to top dead center position thereof illustrated in FIG. 11A, that is, the highest position at which a greatest distance is provided between a rotation axis of the disk cam 32*e* and a first outer circumferential edge of the disk cam 32*e* which contacts the inner circumferential surface of the fixing sleeve 21.

By contrast, when the controller 10 determines in step S13 that the recording medium P is a thin sheet having the thickness TR smaller than the predetermined thickness TP, in step S15 the controller 10 rotates the disk cam 32*e* to bottom dead center, that is, the lowest position at which a smallest distance is provided between the rotation axis of the disk cam 32*e* and a second outer circumferential edge of the disk cam 32*e* which contacts the inner circumferential surface of the fixing sleeve 21. When the disk cam 32*e* is rotated by 180 degrees from the highest position illustrated in FIG. 11A, the disk cam 32*e* is positioned at the lowest position for the thin sheet.

When the fixing device 20U is not yet warmed up, the disk cams 32*e* disposed at both lateral ends of the fixing sleeve 21 in the axial direction thereof do not contact the inner circumferential surface of the fixing sleeve 21. Alternatively, the disk cams 32*e* may be configured to contact the inner circumferential surface of the fixing sleeve 21 when the fixing device 20U is not yet warmed up.

As the fixing device 20U is warmed up and therefore the heater support 23 thermally expands, the thermally expanded heater support 23 moves the fixing sleeve 21 downward in FIG. 11A. Specifically, the thermally expanded heater support 23 is deformed like a bow in which the center portion of the heater support 23 protrudes outward with respect to the lateral end portions of the heater support 23 in the axial direction of the fixing sleeve 21 as illustrated in FIG. 8 when warm-up of the fixing device 20U is finished. The protruding center portion of the heater support 23 presses against and lowers the center portion of the fixing sleeve 21 in the axial direction thereof. Simultaneously, the fixing sleeve 21 comes into contact with the disk cams 32*e* as the heater support 23 lowers the fixing sleeve 21. By contrast, the lateral end portions of the fixing sleeve 21 in the axial direction thereof, which face the heater support 23, tend to separate from the lateral end portions of the laminated heater 22 in the axial direction of the fixing sleeve 21 due to rigidity of the fixing sleeve 21. However, the disk cams 32*e* contacting the lateral end portions of the fixing sleeve 21 prevent the lateral end portions of the fixing sleeve 21 facing the laminated heater 22 from separating from the lateral end portions of the laminated heater 22.

With this configuration, similarly to the fixing sleeve supports 32S depicted in FIG. 9, even when the thermally expanded heater support 23 is deformed like a bow in which the center portion of the heater support 23 protrudes outward with respect to the lateral end portions of the heater support 23 in the axial direction of the fixing sleeve 21 as illustrated in FIG. 8 when warm-up of the fixing device 20U is finished, the fixing sleeve supports 32U support the rotating fixing sleeve 21 while suppressing change in surface pressure with which the laminated heater 22 contacts the fixing sleeve 21, that is, while causing the fixing sleeve 21 to contact the laminated heater 22 over the entire width of the fixing sleeve 21 in the axial direction thereof, thus preventing localized overheating of the laminated heater 22 due to insufficient heat transmission from the laminated heater 22 to the fixing sleeve 21. Further, the rotatable disk cams 32*e* prevent the torque of the driver that drives and rotates the pressing roller 31 from increasing due to frictional resistance between the disk cams 32*e* and the inner circumferential surface of the fixing sleeve 21 sliding over the disk cams 32*e*.

Alternatively, each of the fixing sleeve supports (e.g., the fixing sleeve supports 32, 32S, 32T, and 32U) may be provided with a lubricating layer 32*g* (depicted in FIG. 7) coated with fluorine, for example, as a surface layer. For example, at least a portion of the fixing sleeve support that contacts the inner circumferential surface of the fixing sleeve 21 may include the lubricating layer 32*g* to reduce frictional resistance between the fixing sleeve support and the fixing sleeve 21 sliding over the fixing sleeve support, thus preventing increase of the torque of the driver that drives and rotates the pressing roller 31.

Figure 12:
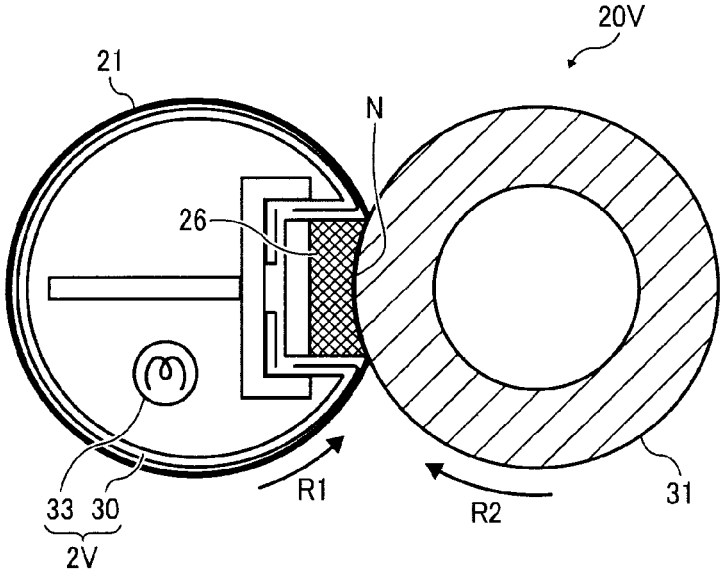
FIG. 12 is a vertical sectional view of a fixing device according to yet another exemplary embodiment of the present invention.

Referring to FIG. 12, the following describes a fixing device 20V according to a fifth illustrative embodiment of the present invention. FIG. 12 is a vertical sectional view of the fixing device 20V. As illustrated in FIG. 12, the fixing device 20V includes the fixing sleeve 21 formed into a loop, the nip formation member 26, and a heating assembly 2V, which are disposed inside the loop formed by the fixing sleeve 21, and the pressing roller 31 disposed outside the loop formed by the fixing sleeve 21.

The heating assembly 2V includes a heat pipe 30 facing the inner circumferential surface of the fixing sleeve 21 and a halogen heater 33 disposed inside the heat pipe 30. The halogen heater 33 serves as a heating member that heats the heat pipe 30 in a predetermined region of the heat pipe 30 serving as a heat transmitter that contacts the fixing sleeve 21 to transmit heat received from the halogen heater 33 to the fixing sleeve 21. That is, the halogen heater 33 and the heat pipe 30 replace the laminated heater 22 depicted in FIG. 7. It is to be noted that the heating member of the fixing device 20V is not limited to a halogen heater and alternatively any heater may be used as the heating member.

Similarly to the heating assembly 2 depicted in FIGS. 7, 9, 10, and 11A that includes the laminated heater 22, the stationary metal heat pipe 30 that supports and guides the rotating fixing sleeve 21 may be overheated due to thermal deformation of the heat pipe 30 in a longitudinal direction thereof parallel to the axial direction of the fixing sleeve 21. Specifically, the heat pipe 30 is deformed like a bow by heat transmitted from the halogen heater 33 in such a manner that a center portion of the heat pipe 30 protrudes outward with respect to lateral end portions of the heat pipe 30 in the longitudinal direction thereof toward the fixing sleeve 21. However, the fixing sleeve 21 having rigidity is not deformed along the thermally deformed heat pipe 30 in the axial direction of the fixing sleeve 21 and therefore is locally isolated from the heat pipe 30 at the lateral end portions of the heat pipe 30. Accordingly, the heat pipe 30 is overheated due to insufficient heat transmission from the heat pipe 30 to the fixing sleeve 21.

Figure 13A:
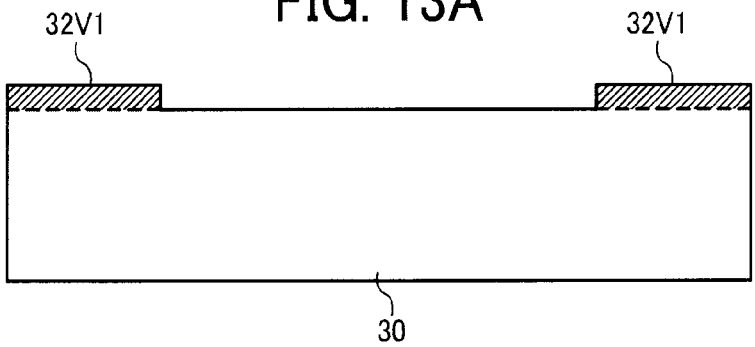
FIG. 13A is a horizontal sectional view of a heat pipe and fixing sleeve supports included in the fixing device shown in FIG. 12.
Figure 13B:
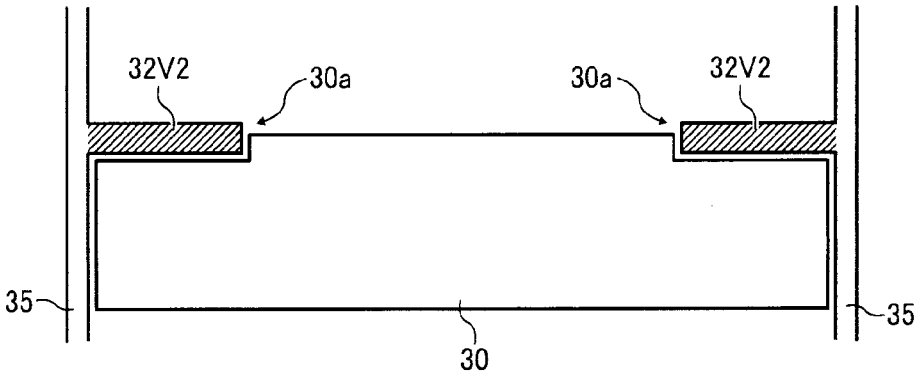
FIG. 13B is a horizontal sectional view of the heat pipe and one variation of the fixing sleeve supports shown in FIG. 13A.

To address this problem, the fixing device 20V includes fixing sleeve supports 32V1 or 32V2 that support the fixing sleeve 21 as illustrated in FIGS. 13A and 13B.

FIG. 13A is a horizontal sectional view of the fixing sleeve supports 32V1 and the heat pipe 30. As illustrated in FIG. 13A, the fixing sleeve supports 32V1 are disposed at lateral ends of the heat pipe 30, respectively, in the longitudinal direction of the heat pipe 30. For example, the fixing sleeve supports 32V1 may be molded with the heat pipe 30.

FIG. 13B is a horizontal sectional view of the fixing sleeve supports 32V2 and the heat pipe 30. As illustrated in FIG. 13B, the fixing sleeve supports 32V2 are molded with the flanges 35, respectively, and engage openings 30*a* disposed at the lateral ends of the heat pipe 30, respectively, in the longitudinal direction of the heat pipe 30.

With the configuration shown in FIGS. 13A and 13B, the fixing sleeve 21 is deformed along the thermally deformed heat pipe 30 in the axial direction of the fixing sleeve 21, preventing overheating of the heat pipe 30 due to insufficient heat transmission from the heat pipe 30 to the fixing sleeve 21.

Referring to FIGS. 3 and 7, the following describes operation of the fixing device 20 also applicable to the fixing devices 20S, 20T, 20U, and 20V.

When the image forming apparatus 1 receives an output signal, for example, when the image forming apparatus 1 receives a print request specified by the user by using the control panel or a print request sent from an external device, such as a client computer, the pressure control mechanism applies pressure to the pressing roller 31 to cause the pressing roller 31 to press the fixing sleeve 21 against the nip formation member 26 to form the nip N between the pressing roller 31 and the fixing sleeve 21.

Thereafter, a driver drives and rotates the pressing roller 31 clockwise in FIG. 7 in the rotation direction R2. Accordingly, the fixing sleeve 21 rotates counterclockwise in FIG. 7 in the rotation direction R1 in accordance with rotation of the pressing roller 31. The heat generation sheet 22*s* of the laminated heater 22 supported by the heater support 23 contacts the inner circumferential surface of the fixing sleeve 21 so that the fixing sleeve 21 slides over the heat generation sheet 22*s*.

Simultaneously, an external power source or an internal capacitor supplies power to the laminated heater 22 via the power supply wiring 25 to cause the heat generation sheet 22*s* to generate heat. The heat generated by the heat generation sheet 22*s* is transmitted effectively to the fixing sleeve 21 contacting the heat generation sheet 22*s*, so that the fixing sleeve 21 is heated quickly. Alternatively, heating of the fixing sleeve 21 by the laminated heater 22 may not start simultaneously with driving of the pressing roller 31 by the driver. That is, the laminated heater 22 may start heating the fixing sleeve 21 at a time different from a time at which the driver starts driving the pressing roller 31.

A temperature detector (e.g., a thermistor) detects a temperature of the fixing sleeve 21 so that heat generation of the laminated heater 22 is controlled based on the temperature detected by the temperature detector to heat the nip N to a predetermined fixing temperature. When the nip N is heated to the predetermined fixing temperature, the fixing temperature is maintained, and a recording medium P bearing a toner image T is conveyed to the nip N.

In the fixing device 20 having the configuration described above, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies stress to the heat generation sheet 22*s* repeatedly, and therefore bends the heat generation sheet 22*s* repeatedly, the heat generation sheet 22*s* is not broken due to wear, resulting in a longer operation of the fixing device 20.

Usually, when the image forming apparatus 1 does not receive an output signal, the pressing roller 31 and the fixing sleeve 21 do not rotate and power is not supplied to the laminated heater 22 to save energy. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

In the fixing devices 20 and 20S according to the above-described exemplary embodiments, the pressing roller 31 is used as a pressing member. Alternatively, a pressing belt or the like may be used as a pressing member to provide effects equivalent to the effects provided by the pressing roller 31. Further, the fixing sleeve 21 is used as a fixing member. Alternatively, an endless fixing belt, an endless fixing film, or the like may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

an endless belt-shaped fixing member formed into a loop and rotatable in a predetermined direction of rotation;

a nip formation member provided inside the loop formed by the fixing member;

a pressing member provided outside the loop formed by the fixing member to press the fixing member against the nip formation member to form a nip between the pressing member and the fixing member through which the recording medium bearing the toner image passes;

a heating assembly disposed facing a first region on an inner circumferential surface of the fixing member to heat the fixing member, the first region being other than the nip in a circumferential direction of the fixing member, the heating assembly thermally deformable to contact and move the fixing member;

a first fixing member support disposed facing a second region on the inner circumferential surface of the fixing member other than the first region and extending inward a predetermined distance from one lateral edge of the fixing member toward a center of the fixing member in an axial direction of the fixing member; and a second fixing member support disposed facing the second region and extending inward a predetermined distance from another lateral edge of the fixing member toward the center of the fixing member in the axial direction of the fixing member, wherein, at least after the fixing device is warmed up, the first fixing member support and the second fixing member support contact and support the rotating fixing member moved by the thermally deformed heating assembly.

2. The fixing device according to claim 1, wherein, after the fixing device is warmed up, the first fixing member support and the second fixing member support contact and support the fixing member moved by the thermally deformed heating assembly and press against the fixing member with uniform pressure in the axial direction of the fixing member.

3. The fixing device according to claim 2, wherein each of the first fixing member support and the second fixing member support comprises an elastic member that contacts the inner circumferential surface of the fixing member.

4. The fixing device according to claim 3, wherein each of the first fixing member support and the second fixing member support further comprises a biasing member that biases the elastic member against the inner circumferential surface of the fixing member.

5. The fixing device according to claim 2, wherein each of the first fixing member support and the second fixing member support comprises an elastic rotor that rotates and contacts the inner circumferential surface of the fixing member.

6. The fixing device according to claim 2, wherein each of the first fixing member support and the second fixing member support comprises a disk cam that rotates and contacts the inner circumferential surface of the fixing member along an outer circumferential edge of the disk cam.

7. The fixing device according to claim 6, wherein the disk cam contacts the inner circumferential surface of the fixing member at top dead center under increased thermal deformation of the heating assembly.

8. The fixing device according to claim 6, wherein the disk cam contacts the inner circumferential surface of the fixing member at bottom dead center under decreased thermal deformation of the heating assembly.

9. The fixing device according to claim 1, wherein the heating assembly comprises:

a laminated heater provided inside the loop formed by the fixing member to heat the first region on the inner circumferential surface of the fixing member; and a heater support provided inside the loop formed by the fixing member to support the laminated heater between the heater support and the fixing member.

10. The fixing device according to claim 1, wherein the heating assembly comprises:

a heating member provided inside the loop formed by the fixing member to generate heat; and a heat transmitter provided inside the loop formed by the fixing member to contact the fixing member to transmit heat received from the heating member to the fixing member.

11. The fixing device according to claim 10, wherein the heating member comprises one of a laminated heater and a halogen heater.

12. The fixing device according to claim 1, wherein the second region on the inner circumferential surface of the fixing member faced by the first fixing member support and the second fixing member support is disposed opposite the first region on the inner circumferential surface of the fixing member faced by the heating assembly via an axis of the fixing member.

13. The fixing device according to claim 1, further comprising:

a first flange disposed facing one lateral edge of the fixing member in the axial direction of the fixing member and mounted with the first fixing member support; and a second flange disposed facing another lateral edge of the fixing member in the axial direction of the fixing member and mounted with the second fixing member support.

14. The fixing device according to claim 1, wherein the fixing member includes a conveyance region therein defined by a maximum recording medium width that the fixing device accommodates, and the first fixing member support and the second fixing member support are provided outside the conveyance region.

15. The fixing device according to claim 1, further comprising a lubricating layer provided to each of the first fixing member support and the second fixing member support that contacts the fixing member.

16. An image forming apparatus comprising the fixing device according to claim 1.

17. The fixing device according to claim 1, wherein, when the fixing device is not yet warmed up, the first fixing member support and the second fixing member support do not contact the fixing member.

* * * * *